United States Patent [19]

Jin

[11] 4,251,293

[45] Feb. 17, 1981

[54] MAGNETICALLY ANISOTROPIC ALLOYS BY DEFORMATION PROCESSING

[75] Inventor: Sungho Jin, Gillette, N.J.

[73] Assignee: Bell Telephone Laboratories, Incorporated, Murray Hill, N.J.

[21] Appl. No.: 16,115

[22] Filed: Feb. 28, 1979

[51] Int. Cl.[3] ..... H01F 1/02

[52] U.S. Cl. ..... 148/101; 148/31.57; 148/120

[58] Field of Search ..... 148/31.57, 101, 102, 148/120, 31.55

[56] References Cited

U.S. PATENT DOCUMENTS

| | | | |
|---|---|---|---|
| 3,660,175 | 5/1972 | Van Melis et al. | 148/102 |
| 3,806,336 | 4/1974 | Kaneko et al. | 75/122 |
| 3,954,519 | 5/1976 | Inoue | 148/31.57 |
| 3,982,972 | 9/1976 | Iwata et al. | 148/31.55 |
| 3,989,556 | 11/1976 | Iwata et al. | 148/31.55 |
| 4,008,105 | 2/1977 | Yuda et al. | 148/101 |
| 4,075,437 | 2/1978 | Chin et al. | 179/114 R |
| 4,093,477 | 6/1978 | Iwata et al. | 148/31.57 |
| 4,120,704 | 10/1978 | Anderson | 148/103 |

OTHER PUBLICATIONS

"Magnetisum and Metallurgy" (Berkowitz & Kneller eds.) 1969 Trauble Chap. XIII, p. 621.

IEEE Trans. Mag. MAG-12, No. 6, Nov. 1976, Kaneko et al. p. 977.

AIP Conf. Proc. No. 29, 1975, Becker et al., p. 620.

J. App. Phys. 34, No. 12, Dec. 1963, p. 3581, Cahn.

J. App. Phys. vol. 34, No. 3, Mar. 1966, p. 1091, Luborsky.

"Ferromagnetism," R. M. Bozorth, 1951, pp. 385–405.

"Permanent Magnets and Magnetism, " D. Hadfield, 1962, pp. 132–135 and p. 164.

AIP Conf. Proc. No. 5, 1972, Kaneko et al., p. 1088.

J. Appl. Physics 49 Mar. 1978, Chin et al. p. 2046.

*Primary Examiner*—R Dean

*Assistant Examiner*—John P. Sheehan

*Attorney, Agent, or Firm*—Peter A. Businger

[57] ABSTRACT

Magnetic alloys are disclosed having an anisotropic magnetic structure produced by thermomechanical treatment in the absence of a magnetic field. Disclosed treatment calls for developing magnetic particles in an alloy by cooling such alloy in a controlled fashion from a first temperature at which the alloy is in a predominantly single phase state to a second temperature at which the alloy is in a multi-phase state.

Treatment further calls for deforming the alloy, resulting in cross-sectional area reduction of at least 30 percent (corresponding to elongation of magnetic particles by a factor of at least 1.7). Disclosed treatment leads to desirable magnetic properties, e.g., in Cu-Ni-Fe, Cu-Ni-Co, Fe-Al-Ni, Fe-Al-Ni-Co, and Fe-Cr-Co alloys. For example, in the case of Fe-Cr-Co, alloy properties such as remanence-to-saturation squareness ratio in excess of 0.90 and maximum energy product in the range of 0.6–8.0 MGOe are achieved.

Disclosed magnetic alloys are suitable for use in the manufacture of telephone ringers, relays, and electromagnetic transducers.

19 Claims, 6 Drawing Figures

MAGNETICALLY ANISOTROPIC ALLOYS BY DEFORMATION PROCESSING

TECHNICAL FIELD

The invention is concerned with magnetic materials.

BACKGROUND OF THE INVENTION

Selection of magnetic materials suitable for use in relays, ringers, and electro-acoustic transducers such as loudspeakers and telephone receivers is characteristically based on magnetic properties such as high magnetic coercivity, remanence, and energy product. Among established alloys having suitable magnetic properties are Fe-Al-Ni, Fe-Al-Ni-Co, Cu-Ni-Fe, and Cu-Ni-Co alloys; more recently, alloys containing Fe, Cr, and Co have been investigated with regard to potential suitability in the manufacture of permanent magnets.

Specifically, Fe-Al-Ni, Fe-Al-Ni-Co, Cu-Ni-Fe and Cu-Ni-Co alloys and alloy processing are disclosed, e.g., in the books by Richard M. Bozorth, "Ferromagnetism," Van Nostrand, New York 1951, pages 385–405, and by D. Hadfield (ed.), "Permanent Magnets and Magnetism," John Wiley and Sons, New York 1962, pages 132–155 and page 164. Certain ternary Fe-Cr-Co alloys are disclosed in the paper by H. Kaneko et al., "New Ductile Permanent Magnet of Fe-Cr-Co System," *AIP Conference Proceedings,* No. 5, 1972, p. 1088 and in U.S. Pat. No. 3,806,336, "Magnetic Alloys" (issued to H. Kaneko et al. on Apr. 23, 1974). Quaternary alloys containing ferrite-forming elements such as, e.g., Ti, Al, Si, Nb, or Ta in addition to Fe, Cr, and Co are disclosed in U.S. Pat. No. 3,954,519, "Iron-Chromium-Cobalt Spinodal Decomposition Type Magnetic Alloy Comprising Niobium and/or Tantalum" (issued to K. Inoue on May 4, 1976), U.S. Pat. No. 3,989,556, "Semihard Magnetic Alloy and a Process for the Production Thereof" (issued to M. Iwata et al. on Nov. 2, 1976), U.S. Pat. No. 3,982,972, "Semihard Magnetic Alloy and a Process for the Production Thereof" (issued to M. Iwata et al. on Sept. 28, 1976), U.S. Pat. No. 4,075,437, "Composition, Processing, and Devices Including Magnetic Alloy" (issued to G. Y. Chin et al. on Feb. 21, 1976), the paper by G. Y. Chin et al., "New Ductile Cr-Co-Fe Permanent Magnet Alloys for Telephone Receiver Applications", *Journal Applied Physics,* Volume 49, No. 3, 1978, p. 2046, the paper by H. Kaneko et al., "Effect of V and V+Ti Additions on the Structure and Properties of Fe-Cr-Co Ductile Magnet Alloys," *IEEE Trans. Mag.,* Volume MAG-12, No. 6, 1976, p. 977, and the paper by H. Kaneko et al., "Fe-Cr-Co Ductile Magnet with $(BH)_{max}=8$ MGOe," *AIP Conf. Proc.,* No. 29, 1976, p. 620. Further development of Fe-Cr-Co alloys and alloy processing is disclosed in pending U.S. patent applications Ser. Nos. 924,137 and 924,138. Fe-Cr-Co alloys containing rare earth additions are disclosed in U.S. Pat. No. 4,120,704, issued Oct. 17, 1978 in the name of Richard L. Anderson.

Highly magnetic alloys typically have a decomposed multi-phase structure comprising at least one strongly magnetic phase and one or several nonmagnetic or weakly magnetic phases. For example, in the case of Fe-Cr-Co alloys, a highly magnetic phase $alpha_1$ is rich in Fe and Co and a weakly magnetic phase $alpha_2$ is rich in Cr. Similarly, in the case of Fe-Ni-Al alloys, a phase $alpha_1$ rich in Fe is highly magnetic and a phase $alpha_2$ rich in Ni and Al is weakly magnetic. Different notation is customarily used in the case of Cu-Ni-Fe alloys, where a strongly magnetic phase rich in Fe and Ni is designated $gamma_2$ and a weakly magnetic phase rich in Cu by $gamma_1$. It is generally postulated that achievement of high coercivity in such alloys is fostered by the development of a so-called spinodal structure, i.e., a submicroscopically fine decomposed two-phase structure in which a highly magnetic phase is interspersed with a weakly magnetic phase. Development of such postulated spinodal structure is typically the result of an aging heat treatment of the alloy at temperatures which correspond to an equilibrium two-phase state and which are at or below a so-called spinodal temperature.

It has been realized that magnetic properties of Fe-Cr-Co alloys can be enhanced by producing anisotropy in a decomposed two-phase structure by an aging heat treatment in the presence of a magnetic field. As disclosed in the paper by J. W. Cahn, "Magnetic Aging of Spinodal Activity," *Journal Applied Physics,* Volume 34, No. 12 (1963), p. 3581, such treatment is characteristically applied to alloys whose spinodal temperature lies close to the Curie temperature. Such treatment may be less applicable, however, to alloys whose spinodal temperature is significantly higher than the Curie temperature as is the case, e.g., for cobalt-free Fe-Al-Ni, low-cobalt Fe-Al-Ni-Co, Cu-Ni-Fe, low-cobalt Fe-Cr-Co alloys, and other alloys as disclosed by F. E. Luborsky, "Permanent Magnets in Use Today," *Journal Applied Physics,* Volume 37, No. 3, page 1091 (1966). Since Co is relatively expensive as a component in magnetic alloys, means for producing strong anisotropy in low-Co and Co-free alloys are commercially desirable.

SUMMARY OF THE INVENTION

According to the invention, anisotropy of decomposed multi-phase structure is produced in magnetic alloys by a treatment which comprises the steps of controlled cooling of an alloy in the absence of a magnetic field from a first temperature at which the alloy is in an essentially single phase state to a second temperature at which the alloy is in a multi-phase state and deforming the alloy to cause an area reduction of preferably at least 30 percent. Among alloys to which such treatment is beneficially applicable are, e.g., Cu-Ni-Fe, Cu-Ni-Co, Fe-Al-Ni, Fe-Al-Ni-Co, and Fe-Cr-Co alloys and, more generally, alloys which undergo phase decomposition upon controlled cooling from a single phase to a multi-phase range, resulting in a fine scale multi-phase structure. Resulting articles have desirable magnetic properties such as, e.g., coercive force in the range of 100–1500 Oersted, remanence in the range of 6000–14000 Gauss, remanence to saturation squareness ratio in excess of 0.9, and maximum energy product in the range of 0.6–8 MGOe. Magnets made from these alloys as treated according to the invention may be used, e.g., in electro-acoustic transducers such as loudspeakers and telephone receivers, in relays, and in ringers.

DETAILED DESCRIPTION

Processing according to the invention is aimed at producing magnetic anisotropy in alloys which undergo phase decomposition upon cooling from a single phase state to a multi-phase state. Phase decomposition may be, e.g., by nucleation and growth or by spinodal decomposition, the latter being preferable in the interest of high magnetic properties in processed alloys. According to the invention, an alloy is cooled in a controlled fashion and in the absence of a magnetic field, and deformed so as to produce magnetic anisotropy.

Alloys of the invention may typically be prepared from constituent elements, e.g., by casting from a melt or by powder metallurgy. In the case of an ingot cast from a melt, processing steps such as, e.g., hot working, cold working, and solution annealing may be included for purposes such as grain refining, shaping, or the development of desirable mechanical properties in the alloy.

Figure 1:
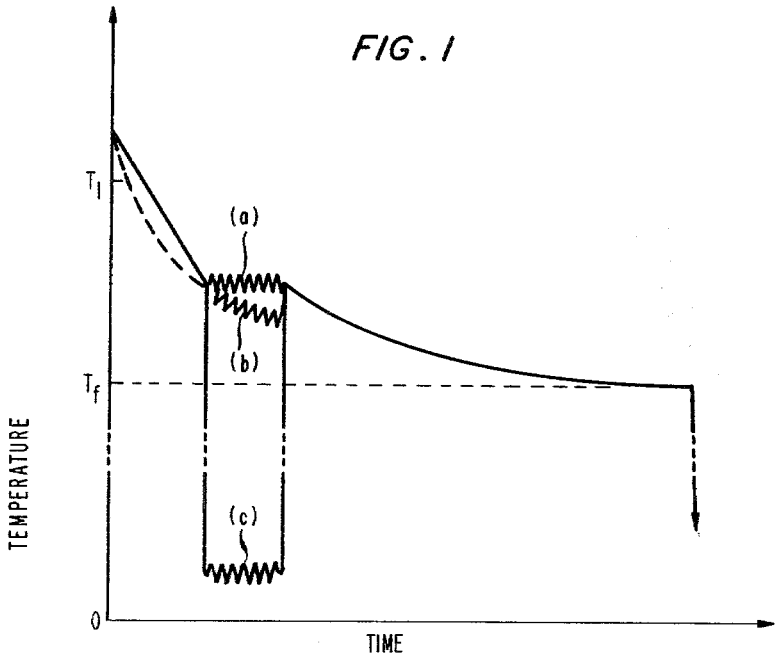
FIG. 1 is a diagram which schematically depicts exemplary functional relationships between time and temperature for processing according to the invention.

As shown in FIG. 1, processing according to the invention is initiated at a first temperature above a critical phase transition temperature $T_1$, i.e., at a temperature at which the alloy is in a predominantly single phase state. The method calls for an initial aging treatment in the course of which temperature is decreased in a controlled fashion from such first temperature above $T_1$, to a second temperature below $T_1$, i.e., to a temperature at which the alloy is in a multi-phase state. Heating rate to achieve the first temperature is not critical and may typically be in the range of $10^2$–$10^6$ degrees C. per hour; holding at the first temperature should preferably continue until an essentially single phase state is produced throughout the alloy and may be subject to a time limitation in the interest of minimizing development of an undesirable phase such as, e.g., a sigma phase which may develop in certain Fe-Cr-Co alloys.

Choice of initial cooling rate for controlled cooling from a first temperature in a single phase range to a second temperature in a multi-phase range is motivated by optimization of ultimate magnetic properties which, in turn, depend upon ultimate size of strongly magnetic particles. Since, after cooling, the method calls for deformation of the alloy, oversize particles are preferred prior to deformation. Depending on the amount of deformation to be imparted, particle size is preferably chosen so as to result in particles which, upon deformation, have a thickness in a preferred range of 200 to 2000 Angstroms. Positive information regarding particle size, both before and after deformation, is conveniently obtained by electron beam transmission microscopic analysis. Cooling may be carried out, e.g., so as to result in a linear decrease in temperature as shown by the solid line in FIG. 1 or so as to result in an exponential decrease as shown by the dashed curve in FIG. 1. If cooling is carried out, e.g., by linearly decreasing furnace temperature, it may be advantageous to include a holding step at a temperature in the multi-phase range, typically for a duration of up to one hour, to achieve uniform temperature distribution in the alloy prior to deformation.

Subsequent to cooling from a first temperature to a second temperature and, possibly, holding at such second temperature as described above, the disclosed method calls for plastic deformation. Amounts of deformation are conveniently expressed in terms of cross-sectional area reduction or, equivalently, in terms of aspect ratio (defined as thickness-to-length ratio) of deformed particles. In the interest of developing magnetic properties, deformation preferably produces at least 30 percent area reduction corresponding to an aspect ratio of 1:1.7. While increased deformation generally leads to increased coercivity and remanence, heavy deformation leads to proportionally less significant increases in magnetic properties. Accordingly, deformation in excess of 80 percent area reduction (corresponding to an aspect ratio of approximately 1:10) may be unnecessary in practice, and near-optimal properties are achieved even at aspect ratios in the vicinity of 1:5, corresponding to deformation resulting in approximately 65 percent area reduction. During deformation, temperature may stay essentially constant as shown in FIG. 1, alternatives (a) and (c), or temperature may vary, e.g., as illustrated by alternative (b). Zigzag lines in FIG. 1 are used not to represent temperature variations but to indicate deformation. Also, time scale is highly non-linear and has been omitted.

Deformation may be carried out either by planar deformation such as by plate or strip rolling or, preferably, by uniaxial deformation such as by rod rolling, wire drawing, extruding or, less conveniently, by swaging. During deformation, temperature generally is at or below the finishing temperature of initial aging. For example, deformation may be carried out at or near room temperature, in which case the alloy preferably is quenched rapidly after initial aging in order to minimize embrittlement.

For thin gauge wire or thin rod shaped magnets, deformation by wire drawing is convenient and fast. Rod rolling or rod drawing, especially when carried out at higher temperatures in a multi-phase range is a preferred method for large scale high speed production of thick rod or bar shaped magnets. Deformation after aging may result in a desired shape as, e.g., in the manufacture of rod magnets. Alternately, desired shape may be produced by additional deformation such as, e.g., by bending, flattening, or machining. For example, in the manufacture of cup shaped telephone receiver magnets, deformation may be by extrusion of a tube and additional shaping by sectioning and cupping.

After deformation and optional additional shaping, an alloy may preferably undergo an additional, final aging treatment aimed at enhancing compositional differentiation by diffusion between phases in a multiphase structure. Such aging may be carried out by cooling the alloy to a final temperature $T_f$ as shown in FIG. 1, final temperature $T_f$ being empirically chosen sufficiently low to optimize magnetic properties while providing for adequate diffusion rate. Exponential temperature decrease as shown by the solid curve in FIG. 1 is desirable in the interest of phase separation; alternately, such curve may be approximated by a number of discrete steps or by a linear or piecewise linear curve, followed by holding for a period of 0–10 hours at the final temperature.

Upon completion of such final aging treatment, the alloy may be air cooled or water quenched to room temperature. Additional shaping such as, e.g., by grinding or machining may also take place after final aging. Plastic deformation, while not precluded, is more difficult at this point.

Figure 4:
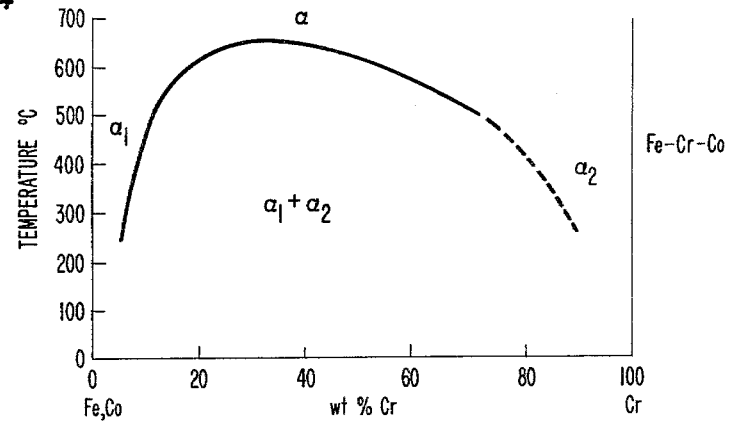
FIG. 4 is an equilibrium phase diagram along the tie line of the (Fe, Co)-Cr pseudobinary system.
Figure 5:
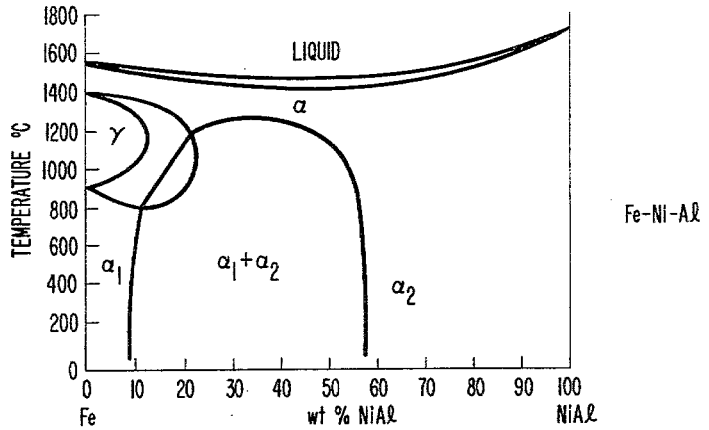
FIG. 5 is an equilibrium phase diagram along the tie line of the Fe-(Ni, Al) pseudobinary system.
Figure 6:
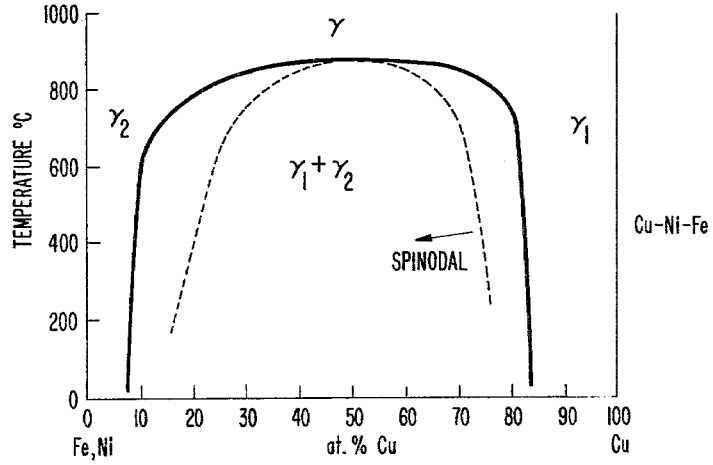
FIG. 6 is an equilibrium phase diagram along the tie line of the (Fe, Ni)-Cu pseudobinary system.

The method as described above is applicable, e.g., to Fe-Cr-Co, Fe-Al-Ni, Fe-Al-Ni-Co, Cu-Ni-Fe, Cu-Ni-Co, and other alloys which undergo phase decomposition; specific values for phase boundary temperature being conveniently available from FIGS. 4, 5, and 6 and the paper by Luborsky cited above. For example, it can be seen from FIG. 4 that phase boundary temperature for Fe-Cr-Co alloys containing 20–40 weight percent Cr are in the vicinity of 650 degrees C. Accordingly, such alloys are processed according to the disclosed method by heating to a preferred initial temperature above 650 degrees C. While much higher initial temperatures are not precluded, temperatures above approximately 775 degrees C. are considered to be less practical. Cooling into the multi-phase region preferably proceeds to a temperature which lies in the vicinity of 600 degrees C. and, depending on alloy composition, in a preferred range of 575–625 degrees C. Cooling to temperatures below approximately 555 degrees C. is considered less desirable in the interest of maintaining ductility.

Cooling rate to produce oversize particles may be chosen in a preferred range of 0.5–100.0 degrees C. per hour and, especially in the interest of maximizing energy product, in a preferred range of 2–60 degrees C. per hour. Preferred cooling rates depend on alloy composition, preferred rates being higher, e.g., for higher levels of Co. In particular, rates in the range of 4–8 degrees C. per hour are preferred when cobalt content is approximately 7 weight percent and rates in the range of 30–50 degrees C. per hour are preferred when cobalt content is approximately 12 weight percent. Preferred ranges corresponding to other levels of Co may conveniently be obtained by approximate linear interpolation between limits of preferred ranges at 7 and 12 percent Co.

Preferred final aging of Fe-Cr-Co alloys is from a temperature in a preferred range of 575–625 degrees C. to a final temperature in the preferred range of 470–570 degrees C. at preferred rates not exceeding 30 degrees C. per hour resulting in enhanced compositional separation of phases. For practical reasons, cooling rate is preferably not less than 2 degrees C. per hour.

Figure 2:
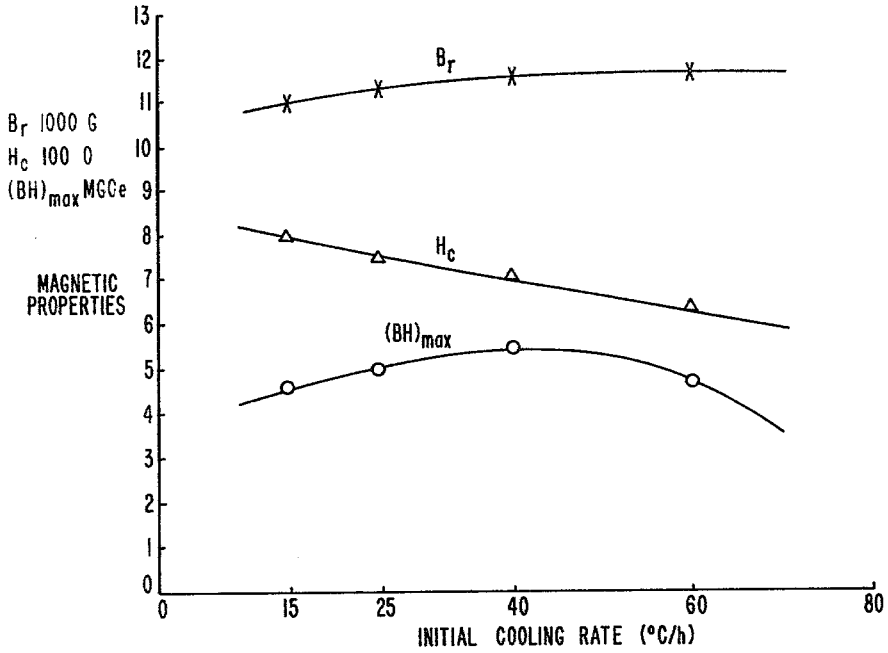
FIG. 2 is a diagram which graphically depicts magnetic properties as a function of initial cooling rate for an alloy composed of 33 weight percent Cr, 11.5 weight percent Co, and remainder Fe and processed according to methods within the scope of the invention.

FIG. 2 illustrates the influence of initial cooling rate on magnetic properties of a specific alloy containing 33 weight percent Cr, 11.5 weight percent Co, and remainder Fe. Measurements shown were made on rod sample which were processed by holding at a temperature of 680 degrees C. for 30 minutes, continuously cooling to 600 degrees C. at indicated rates, and water cooling. Samples were then wire drawn resulting in a 67 percent reduction in area, reheated to a temperature of 600 degrees C., cooled at rates decreasing exponentially from 15 to 2 degrees C./h to a temperature of 480 degrees C., and finally air cooled. It can be seen from FIG. 2 that, while energy product is maximized when an initial cooling rate of approximately 40 degrees C./h is chosen, coercive force steadily increases as cooling rate decreases.

Figure 3:
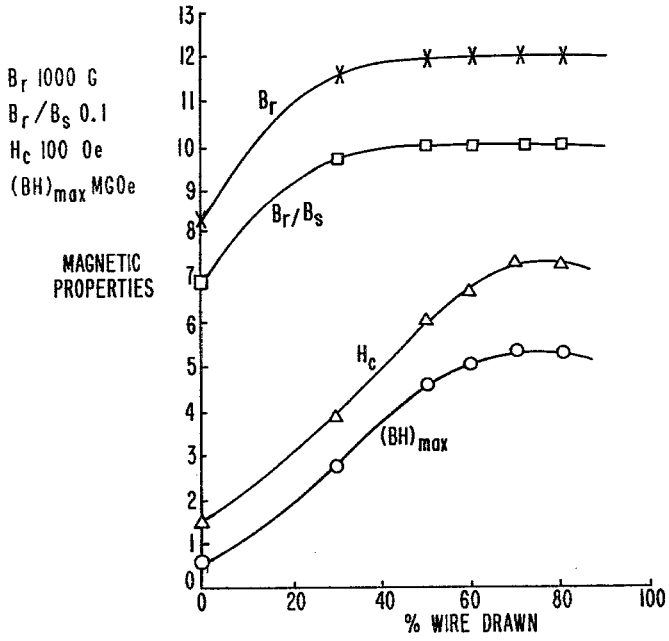
FIG. 3 is a diagram which graphically depicts magnetic properties as a function of percent reduction in cross-sectional area by wire drawing for an alloy composed of 33 weight percent Cr, 11.5 weight percent Co, and remainder Fe and processed according to methods within the scope of the invention.

FIG. 3 shows the effect of different amounts of deformation on magnetic properties for an exemplary alloy containing 33 weight percent Cr, 11.5 weight percent Co and remainder Fe. Processing was as described above regarding FIG. 2 except that all samples were cooled at a fixed rate of 40 degrees C./h but deformed by different amounts. It can be seen from FIG. 3 that processing involving deformation according to the invention results in substantially enhanced magnetic properties as compared with processing in which no deformation is involved.

Constituent elements Fe, Cr, and Co, in combination should preferably be present in the alloy in an amount of at least 95 weight percent; the remaining at most 5 weight percent may comprise one or several elements such as, e.g., ferrite forming elements Zr, Mo, V, Nb, Ta, Ti, Al, Si, or W, rare earth additions, or impurities N, C, O, or Mn. In the interest of minimizing an undesirable nonmagnetic gamma phase, impurities should preferably be present in the alloy in amounts of less than 0.05 weight percent N, less than 0.05 weight percent C, less than 0.1 weight percent O, less than 0.5 weight percent Mn. Ferrite forming elements may be added to counteract gamma formation in amounts of at least 0.1 weight percent but, in order to minimize development of an undesirable sigma phase, their presence in the alloy should not exceed the following preferred limits: 1 weight percent Zr, 5 weight percent Mo, 5 weight percent V, 3 weight percent Nb, 3 weight percent Ta, 5 weight percent Ti, 3 weight percent Al, 3 weight percent Si, and 5 weight percent W.

In the interest of sufficient decomposition of phases, Cr content is preferably at least 20 weight percent and, in the interest of minimizing formation of sigma phase, Cr content is preferably not more than 40 weight percent of the combined Fe-Cr-Co content of the alloy. In the interest of adequate kinetic response, Co content is preferably at least 3 weight percent and, in the interest of minimizing formation of gamma phase, Co content is preferably not more than 20 weight percent of the combined Fe-Cr-Co content of the alloy.

Superior magnetic properties are achieved when Co content is at least 5 weight percent. To minimize formation of nonmagnetic gamma phase, in the absence of ferrite forming elements, Co content should preferably not exceed 15 weight percent.

The disclosed aging-deformation-aging method, as applied to Fe-Cr-Co alloys, may be viewed as conducive to the production of an anisotropic fine-scale decomposed two-phase structure comprising an iron-rich phase and a chromium rich phase. Such structure may be due predominantly to nucleation and growth or, preferably, may be due to predominant spinodal decomposition as desirable in the interest of developing high squareness of hysteresis and high coercivity in the alloy. In terms of such structure, particle size and morphology of the iron-rich phase is optimized, prior to optimization of compositional difference between phases, by an aging treatment followed by plastic deformation which elongates the particles in the direction of deformation and reduces the particle diameter or thickness to the optimum value. Additional final aging increases the compositional amplitude of the elongated particles and improves the magnetic properties. On account of elongated particle shape, strong magnetic anisotropy is developed which results in a marked increase in squareness of hysteresis loop and magnetic energy product.

Magnetic properties obtained in Fe-Cr-Co magnetic alloys generally are a coercive force in the range of 100–1500 Oersted, a remanence in the range of 9000–14000 Gauss, a remanence-to-saturation squareness ratio in the range of 0.90 to 0.99, and a maximum energy product in the range of 0.6–8 MGOe. Moreover, as a consequence of plastic deformation, grains are elongated so as to result in aspect ratios in a preferred range of 1:1.7 to 1:20.

There are several aspects of the disclosed method which make it particularly suitable for large scale industrial practice. For example, initial temperature and holding time may vary within relatively wide ranges, features which are advantageous where heavy loads are processed, where prolonged heating is required to reach equilibrium temperature, and where, even at equilibrium temperature, there may be some nonuniformity of temperature inside a large furnace. Also, small variations in alloy composition as they may occur from heat to heat are easily accommodated. Further, key advantages of the new method are ease of processing in the absence of a magnetic field and applicability to alloys for which Curie temperature is substantially lower than spinodal temperature, such latter feature being particularly advantageous in the case of alloys whose Curie temperature is lower than spinodal temperature by at least 20 degrees C. In the case of Fe-Cr-Co alloys, high magnetic properties are achieved at relatively low cobalt levels, e.g., a maximum energy product $(BH)_{max}$ in excess of 5 MGOe, a coercive force of 800 Oersted, and a remanence of 12000 Gauss are achieved in an alloy containing 11.5 weight percent Co. Such properties are comparable to those obtainable in widely used high energy Fe-Al-Ni-Co permanent magnet alloys which contain significantly higher levels of Co and which require complicated magnetic field heat treatment.

In addition to being due to elongation of two-phase decomposed structure, enhanced properties may be due to other physical effects such as, e.g., texture formation, increased densities of dislocations and point defects caused by plastic deformation at relatively low temperatures. According to H. Trauble, "The Influence of Crystal Defects on Magnetization Process in Ferromagnetic Single Crystals," *Magnetism and Metallurgy,* Volume 2, page 621, 1969, (A. Berkowitz and E. Kneller, editors), an increase in dislocations and point defects leads to increased coercivity. Moreover, deformation-induced enhanced kinetics of phase decomposition during final aging may also enhance properties. Finally, effects such as grain elongation, reduction of grain diameter or thickness, and high density of dislocations and point defects all contribute to increased mechanical strength which may, in the interest of rigidity and stability in service, be a significant factor especially in thin or small-diameter magnets.

Magnets made from the deformation induced anisotropic alloy of the invention may serve, e.g., as magnets in relays, ringers, electro-acoustic transducers such as loudspeakers and telephone receivers.

In the following examples, preliminary preparation of alloy samples was carried out by conventional melting, casting, hot working, cold working, and solution annealing. Magnetic properties corresponding to each sample are tabulated in Table I.

EXAMPLE 1

0.1 inch diameter rod samples of an alloy containing 27 weight percent Cr, 10.5 weight percent Co, and remainder Fe were given an initial aging treatment by holding at 700 degrees C. for one hour, continuously cooling at a rate of 15 degrees/h, and quenching. The samples were then deformed by wire drawing resulting in 55 percent area reduction. The alloy was reheated to a temperature of 600 degrees and cooled at rates decreasing exponentially from 15 to 2 degrees C./h to a final temperature of 480 degrees C., followed by air cooling.

EXAMPLE 2

Sample size, composition and processing were the same as in Example 1 except that swaging was used instead of wire drawing.

EXAMPLE 3

0.1 inch diameter rod samples of an alloy containing 33 weight percent Cr, 11.5 weight percent Co, and remainder Fe were held at 680 degrees C. for 30 minutes, continuously cooled to 600 degrees C. at a rate of 40 degrees C./h, and water cooled. The samples were wire drawn resulting in a 67 percent reduction in area, and were given a final aging heat treatment as in Example 1.

EXAMPLE 4

Rod samples of an alloy containing 29 weight percent Cr, 13.5 weight percent Co, and remainder Fe were held at 680 degrees C. for 30 minutes, cooled to 605 degrees C. at rates decreasing from 80 to 40 degrees C./h and held for 30 minutes before water quenching. After wire drawing by 60 percent area reduction, final aging treatment was given as in Example 1.

EXAMPLE 5

Several 0.1 inch thick samples of an alloy having the same composition as the alloy of Example 1 were held at 660 to 720 degrees C. for times in the range of 10 minutes to one hour. Samples were continuously cooled to a temperature in the range of 585 to 615 degrees C. at a rate of 25 degrees C./h and water cooled. After intermediate deformation resulting in 50 to 70 percent reduction in area by cold rolling, the samples were given final aging as in Example 1.

EXAMPLE 6

0.8 inch diameter rods of an alloy containing 33 weight percent Cr, 11.7 weight percent Co, and remainder Fe were held at 680 degrees C. for 1 hour, continuously cooled at a rate of 40 degrees C./h to 605 degrees C., cooled to 400 degrees C., and warm swaged at that temperature into 0.50 inch diameter rods resulting in an area reduction of 61 percent, and air cooled. Final aging heat treatment was given as in Example 1.

EXAMPLE 7

Rod samples of an alloy containing 30 weight percent Cr, 10 weight percent Co, 0.7 weight percent Si, and remainder Fe were given an initial aging treatment by holding at 670 degrees C. continuously cooling at a rate of 15 degrees C./h, and quenching. Samples were deformed by wire drawing resulting in 60 percent area reduction, reheated to a temperature of 600 degrees, and cooled at rates decreasing exponentially from 15 to 2 degrees C./h to a final temperature of 480 degrees C.

EXAMPLE 8

Rod samples of an alloy containing 25 weight percent Cr, 8 weight percent Co, 1.3 weight percent Si, and remainder Fe were processed as described in Example 7.

EXAMPLE 9

Rod samples of an alloy containing 29 weight percent Cr, 15 weight percent Co, 1 weight percent Al, 0.4 weight percent Zr, and remainder Fe were processed as described in Example 7 except that initial cooling was at a rate of 50 degrees C. per hour, and final cooling was at rates decreasing from 30 to 2 degrees C./h.

EXAMPLE 10

Rod samples of an alloy containing 33 weight percent Cr, 7 weight percent Co, and remainder Fe were processed by heating to 650 degrees C., continuously cooling to 590 degrees C. at a rate of 4 degrees C. per hour, and quenching. Samples were deformed at room temperature by wire drawing resulting in 65 percent area reduction, reheated to 585 degrees C., and continuously cooled to 500 degrees C. at a rate of 8 degrees C. per hour.

TABLE 1

| Example | $B_r$ Gauss | $B_r/B_s$ | $H_c$ Oersted | $(BH)_{max}$ MGOe |
|---|---|---|---|---|
| 1 | 13300 | 0.99 | 500 | 4.2 |
| 2 | 13200 | 0.98 | 450 | 3.4 |
| 3 | 12000 | 0.99 | 785 | 5.3 |
| 4 | 13000 | 0.99 | 570 | 4.8 |
| 5 | 12500 | 0.91 | 450 | 3.1 |
| 6 | 11780 | 0.99 | 660 | 4.5 |
| 7 | 11700 | 0.98 | 500 | 4.2 |
| 8 | 12210 | 0.98 | 250 | 2.0 |
| 9 | 12600 | 0.98 | 470 | 3.7 |
| 10 | 11900 | 0.99 | 460 | 3.5 |

I claim:

1. Method for producing a magnetic element, said method comprising thermo-mechanical treatment of an alloy which has a characteristic temperature, here designated $T_1$, such that said alloy is in a solid, predominantly single phase state at temperatures in a first temperature range whose lower limit is $T_1$, and such that said alloy is in a multi-phase state at temperatures in a second temperature range whose upper limit is $T_1$, characterized in that said treatment comprises the steps of (1) developing in said alloy particles of a strongly magnetic phase by controlled lowering of temperature from a first temperature in said first range to a second temperature in said second range, and (2) developing magnetic anisotropy in said alloy by plastically deforming said alloy so as to result in a cross-sectional area reduction of at least 30 percent while the temperature of said alloy is in said second range, whereby said particles are deformed resulting in a particle thickness in the range of 200–2000 Angstroms.

2. Method of claim 1 in which said alloy is aged after deforming.

3. Method of claim 1 in which said alloy is selected from the group consisting of Cu-Ni-Fe, Cu-Ni-Co, Fe-Al-Ni, Fe-Al-Ni-Co, and Fe-Cr-Co.

4. Method of claim 3 in which an amount of at least 95 weight percent of the composition of said alloy consists of Fe, Cr, and Co, Cr content of said alloy being in the range of 20–40 weight percent of said amount and Co content of said alloy being in the range of 3–20 weight percent of said amount.

5. Method of claim 4 in which said second temperature is in the range of 575–625 degrees C. and in which the temperature of said alloy is lowered from said first to said second temperature at a rate which over essentially the entire range of temperatures between said first temperature and said second temperature is in the range of 0.5–100.0 degrees C. per hour.

6. Method of claim 5 in which said alloy, after deforming, is aged by lowering the temperature of said alloy from a second temperature in the range of 575–625 degrees C. to a third temperature in the range of 470–570 degrees C. at a rate which over essentially the entire range of temperatures between said second and said third temperature is less than 30 degrees C. per hour.

7. Method of claim 4 in which said alloy comprises at least one ferrite forming element selected from the group consisting of 0.1–1 weight percent Zr, 0.1–5 weight percent Mo, 0.1–5 weight percent V, 0.1–3 weight percent Nb, 0.1–3 weight percent Al, 0.1–3 weight percent Si, and 0.1–5 weight percent W.

8. Method of claim 4 in which said alloy consists essentially of Fe, Cr, and Co, Co content of said alloy being in the range of 5–15 weight percent of said amount.

9. Method of claim 4 in which said first temperature is in the range of 650–775 degrees C.

10. Method of claim 1 in which temperature is lowered essentially linearly from said first temperature to said second temperature.

11. Method of claim 1 in which temperature is lowered essentially exponentially from said first temperature to said second temperature.

12. Method of claim 1 in which said alloy during deforming is at said second temperature.

13. Method of claim 4 in which said alloy prior to deforming is quenched to room temperature.

14. Method of claim 4 in which deforming is carried out by rolling, extrusion, or drawing.

15. Method of claim 5 in which lowering temperature from said first temperature to said second temperature is at rates which over essentially the entire range of temperatures between said first temperature and said second temperature are in the range of 1–60 degrees C./h.

16. Method of claim 6 in which lowering temperature from said second temperature to said third temperature is at rates which over essentially the entire range of temperatures between said first temperature and said second temperature are not less than 2 degrees C./h.

17. Magnetic article comprising a body of an alloy which, upon cooling from a first temperature to a second temperature has undergone a phase transformation from a predominantly single phase state to a multi-phase state, said multi-phase state being a predominantly spinodal state, said alloy having a Curie temperature and a spinodal temperature, said Curie temperature being less than said spinodal temperature and characterized in that spinodal structure and grains of said alloy are elongated so as to have an aspect ratio in the range of 1:1.7 to 1:20.

18. Article of claim 17 in which Curie temperature is less than spinodal temperature by at least 20 degrees C.

19. Article of claim 17 in which an amount of at least 95 weight percent of the composition of said alloy consists of Fe, Cr, and Co.

* * * * *